US008656873B2

(12) United States Patent
Keller et al.

(10) Patent No.: US 8,656,873 B2
(45) **Date of Patent: *Feb. 25, 2014**

(54) OIL CONTROL VALVE ASSEMBLY FOR ENGINE CAM SWITCHING

(75) Inventors: Robert Dean Keller, Davisburg, MI (US); Gerrit VanVranken Beneker, Lake Orion, MI (US); Robert John Boychuk, Sterling Heights, MI (US); Leo Joseph Buresh, III, Warren, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/603,936

(22) Filed: Sep. 5, 2012

(65) Prior Publication Data

US 2013/0000574 A1 Jan. 3, 2013

Related U.S. Application Data

(63) Continuation of application No. 12/692,865, filed on Jan. 25, 2010, now Pat. No. 8,302,570.

(60) Provisional application No. 61/147,543, filed on Jan. 27, 2009.

(51) Int. Cl.
*F01L 9/02* (2006.01)

(52) U.S. Cl.
USPC ..... 123/90.12; 123/90.13; 123/90.16

(58) Field of Classification Search
USPC ..... 123/90.12, 90.13, 90.16
See application file for complete search history.

(56) References Cited

U.S. PATENT DOCUMENTS 4,545,342 A 10/1985 Nakano et al.
8,302,570 B2 * 11/2012 Keller et al. ..... 123/90.12

FOREIGN PATENT DOCUMENTS

EP 0353988 A1 2/1990

OTHER PUBLICATIONS

European Search Report, European Patent Office, Apr. 19, 2013, Munich Germany.

* cited by examiner

*Primary Examiner* — Ching Chang
(74) *Attorney, Agent, or Firm* — Quinn Law Group, PLLC

(57) ABSTRACT

An oil control valve assembly for an engine is provided that has a control valve with a valve body, and a manifold that defines a control passage in fluid communication with a valve lift switching component and an exhaust passage for exhausting fluid from the valve. The control valve is controllable to selectively direct fluid from a supply source to the control passage to actuate the valve lift switching component. An elongated tubular member is positioned adjacent the engine component and is operatively connected to the exhaust passage such that fluid flows from the exhaust passage to the elongated tubular member and through the elongated tubular member onto the engine component.

20 Claims, 4 Drawing Sheets

OIL CONTROL VALVE ASSEMBLY FOR ENGINE CAM SWITCHING

CROSS-REFERENCE TO RELATED APPLICATIONS

This application is a continuation application of U.S. application Ser. No. 12/692,865, filed Jan. 25, 2010, which claims the benefit of U.S. Provisional Application No. 61/147,543, filed Jan. 27, 2009, both of which are hereby incorporated by reference in their entireties.

TECHNICAL FIELD

The invention relates to an oil control valve assembly operatively connected to a drip rail in an engine.

BACKGROUND OF THE INVENTION

Hydraulic control systems for engines are used to control oil under pressure that may be used to switch latch pins in switching lifters, lash adjusters, and rocker arms for cam switching. Valve lifters are engine components that control the opening and closing of exhaust and intake valves in an engine. Rocker arms are used to change the lift profile of camshafts. Lash adjusters may also be used to deactivate or vary exhaust and intake valves in an engine. By varying valve lift, fuel efficiency of an engine may be improved. Camshafts and other rotating, sliding or otherwise movable components within the engine require lubrication. In some engines, fluid is pumped to a drip rail positioned above the components to provide the necessary lubrication.

SUMMARY OF THE INVENTION

An oil control valve assembly for an engine is provided that has a control valve with a valve body which defines both a control passage in fluid communication with a valve lift switching component, such as a switching rocker arm or switching lash adjuster, and an exhaust passage for exhausting fluid from the valve. The control valve is controllable to selectively direct fluid from a supply source to the control passage to actuate the valve lift switching component. An elongated tubular member, such as a drip rail, is positioned adjacent the engine component and is operatively connected to the exhaust passage such that fluid flows from the exhaust passage to the elongated tubular member and through the elongated tubular member onto the engine component. In this manner, oil flow need not be separately directed to the elongated tubular member from the supply source. Oil flow requirements are reduced, thus saving energy.

The oil control valve assembly includes a pressure relief valve in fluid communication with the exhaust passage that is configured to open when pressure in the exhaust passage reaches a predetermined pressure that is less than a minimum pressure required to actuate the valve lift switching component. The pressure relief valve thus helps to maintain a residual pressure to the valve lift switching component. This prevents air from entering the passages or reaching the valve lift switching components, which would disrupt actuation timing. Maintaining a residual pressure also decreases the time required to raise the pressure level to the minimum pressure required for actuation, thus decreasing actuation response time. The pressure relief valve may be between the exhaust passage and the elongated tubular member, in which case, fluid drips from the elongated tubular member by gravity only. Alternatively, the elongated tubular member may be between the exhaust passage and the pressure relief valve such that fluid within the elongated tubular member is pressurized up to the predetermined pressure at which the relief valve opens. A pressurized elongated tubular member ensures lubrication of the engine components even at low temperatures. Other means of dispensing pressurized oil to lubricate the engine components, such as through squirters in the rocker arms are unnecessary.

A feed passage is in fluid communication with the supply source and also with an engine cam phaser, causing fluid pressure in the feed passage to vary. A pressure regulator valve is configured to regulate fluid pressure provided to the supply passage and the bypass passage through the feed passage. Supply pressure is thus stabilized, making response times more consistent over a variety of temperature and pressure fluctuations in the fluid provided from the supply source. For example, interference caused by fluid demand of other hydraulic valves and components is reduced. Because the maximum pressure is controlled, the apertures in the elongated tubular member can be larger. This is especially beneficial if fluid in the elongated tubular member is not pressurized, as adequate fluid flow through the apertures at low temperatures requires sufficiently large apertures.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
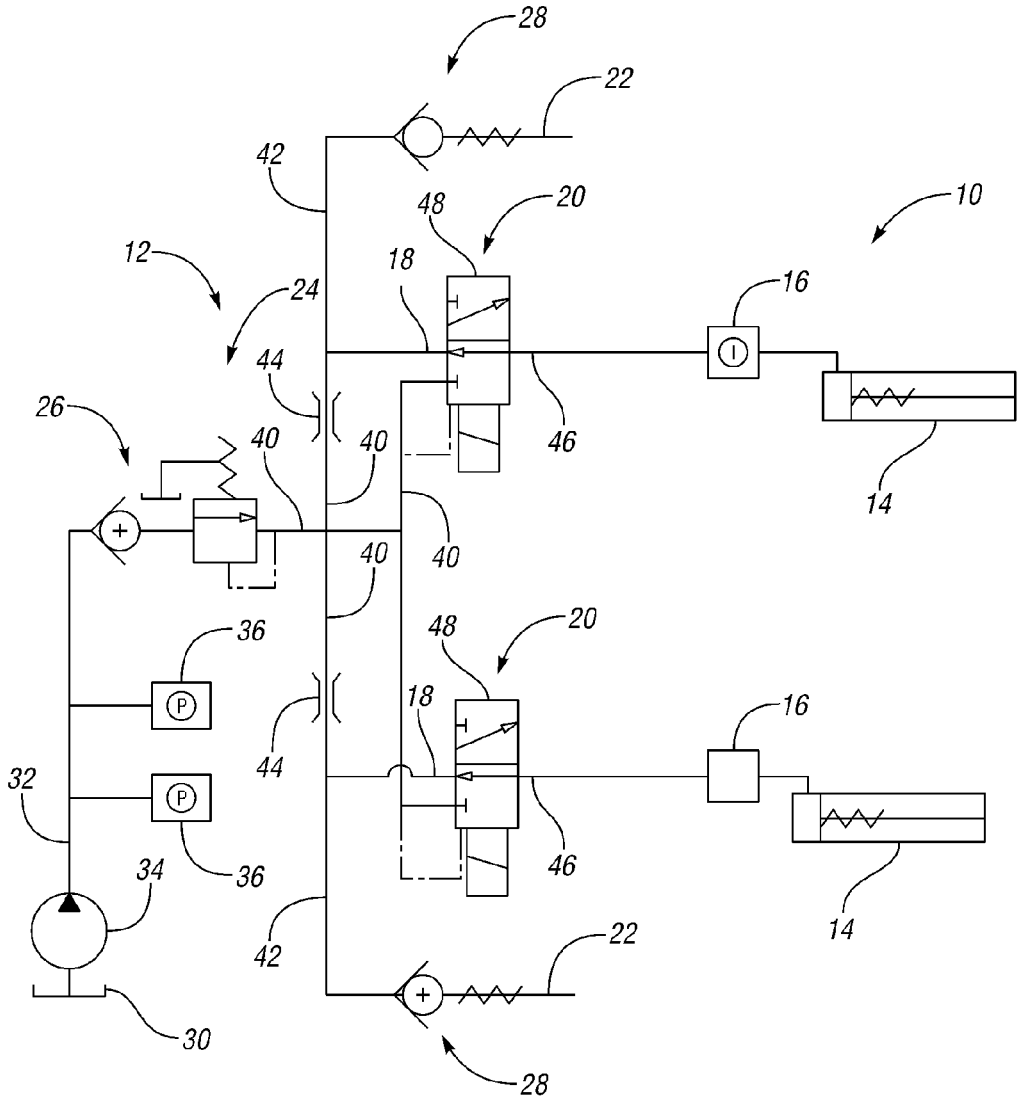
FIG. 1 is a schematic representation of an engine with a hydraulic control system.

Referring to the drawings, wherein like reference numbers refer to like components throughout the several views, FIG. 1 shows a portion of an engine 10 including a hydraulic control system 12 that controls hydraulic fluid flow to engine valve lift switching components such as rocker arms 14 and lash adjusters 16, and directs fluid flow from an exhaust passage 18 of an oil control valve 20 to drip rails 22 that lubricate other engine components as explained herein.

The hydraulic control system 12 shown in FIG. 1 illustrates control of hydraulic fluid to two oil control valves 20, each affecting fluid flow to a different drip rail 22, rocker arm 14 and lash adjuster 16. The drip rails 22 are also referred to herein as elongated tubular members. The number of control valves 20, and the number of rocker arms 14 and lash adjusters 16 affected by each control valve 20 depends in part on the timing requirements of the engine 12, and may be different than that shown in the exemplary embodiment of FIG. 1. The control valves 20 are part of an oil control valve assembly 24 that also includes a pressure regulator valve 26 and pressure relief valves 28, the function and operation of which are described below.

The engine 10 has an oil sump 30 containing hydraulic fluid, also referred to herein as oil, that is pressurized and directed through a feed passage 32 by a pump 34. Some of the oil in the feed passage 32 is used by cam phaser valves 36 that adjust and retard cam timing based on factors such as engine speed and load. Because the cam phasers 36 intermittently draw fluid from the feed passage 32, pressure in the feed passage 32 varies. In order to regulate fluid pressure flowing to the oil control valves 20 and avoid extreme fluctuations, the pressure regulator valve 26 moderates pressure supplied from the feed passage 32 through the regulator valve 26 to supply passage 40, which feeds into both of the control valves 20. The pressure regulator valve 26 is shown and described in further detail with respect to FIG. 4, below.

Flow through the bypass passage 42 must pass through a restriction 44 (also referred to as a first orifice) dropping the pressure and limiting flow. This, in combination with the regulated pressure, causes a consistent flow rate to the drip rail 22. In the embodiment shown, which is described further with respect to FIG. 2, a pressure relief valve 28 is positioned between the bypass passage 42 and the drip rail 22. The pressure relief valve 28 permits fluid flow to the drip rail 22 when a sufficient pressure is reached in the bypass passage 42 that will improve actuation speed of the rocker arm 14 and lash adjuster 16, but that is not high enough to cause actuation of the rocker arm 14 and lash adjuster 16. Due to the restriction 44 and deliberate sizing of the passages 40, 42, fluid pressure provided to the supply passage 40 is greater than fluid pressure in the bypass passage 42 downstream of the restriction 44.

The oil control valve 20 also has a control passage 46 in fluid communication with the rocker arm 14 and lash adjuster 16. In FIG. 1, a valve member 48 of the oil control valve 20 is shown in a position that blocks fluid communication from the supply passage 40 to the control passage 46 so that the rocker arm 14 and lash adjuster 16 are not actuated by the higher fluid pressure in the supply passage 40. Instead, fluid pressure allowed by the relief valve 28 is communicated through passage 42, the control valve 20 and the passage 46 to the rocker arm 14 and lash adjuster 16. Control of the oil control valve 20 and fluid flow to the drip rail 22 is described in greater detail with respect to the embodiments of oil control valve assemblies 24 and 24A of FIGS. 2 and 3.

Figure 2:
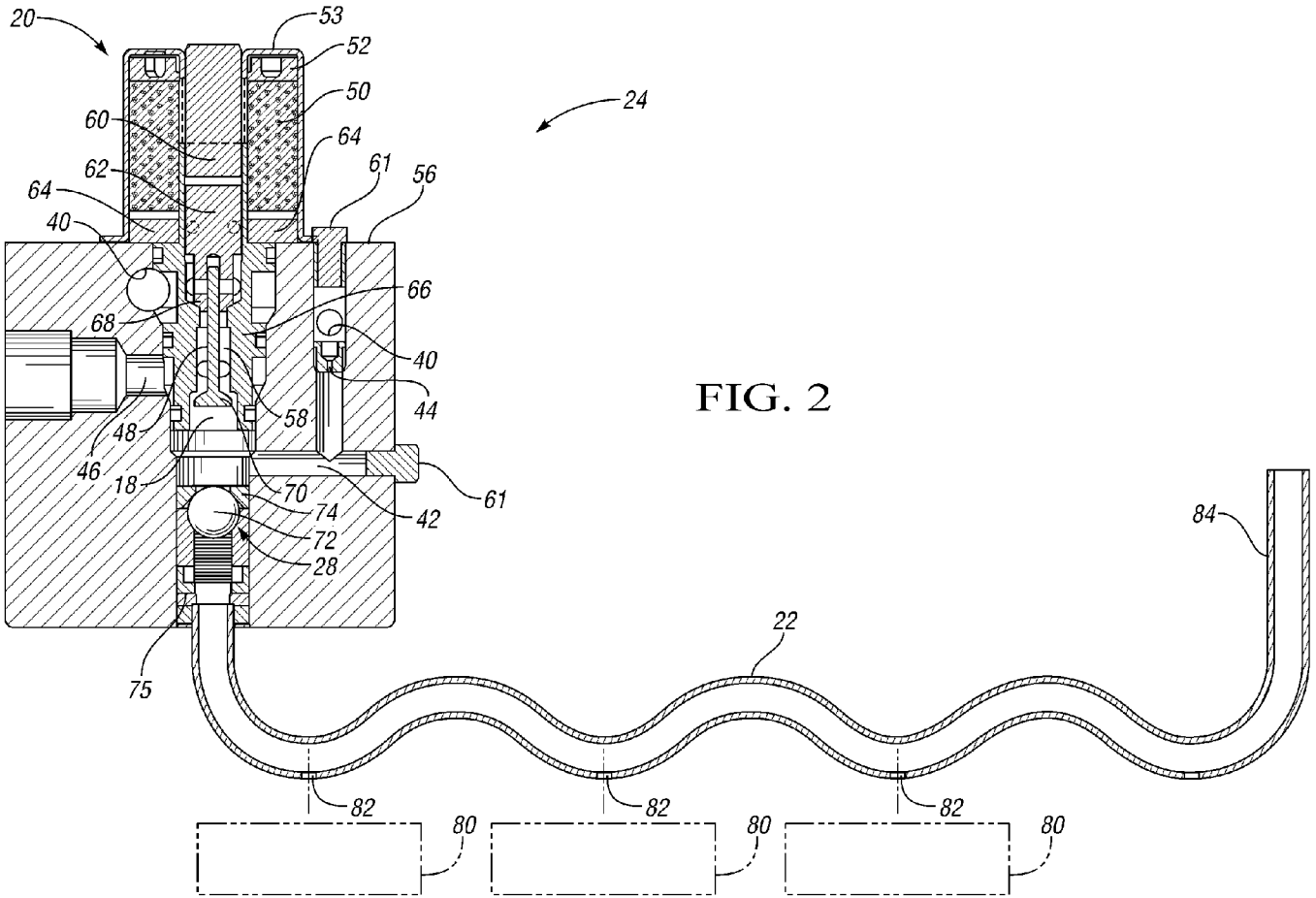
FIG. 2 is a schematic cross-sectional illustration of one embodiment of an oil control valve, pressure relief valve and drip rail for the hydraulic control system of FIG. 1.

In FIG. 2, a portion of the oil control valve assembly 24 of FIG. 1 is shown. The oil control valve 20 is shown as a solenoid valve having an electrical coil 50 supported by a coil support portion 52 (also referred to as a bobbin) and covered by a coil cover 53(also referred to as a can). The control valve 20 includes a manifold 56 that defines an armature chamber 58 in which a pole piece 60 is fit. Manifold 56 defines the supply passage 40, bypass passage 42, exhaust passage 18 and control passage 46. Plugs 61 close off branches within manifold 56 leading to the passages 18 and 42.

An armature 62 and the valve member 48 connected thereto are movable in the armature chamber 58 in response to energizing of the coil 50. A flux collector 64 (also referred to as a flux bracket) is supported adjacent the coil 50 and armature 62 by a valve body 66 of the manifold 56. Electrical wiring for energizing of the coil 50 may be connected with the coil 50 through wiring openings or through an electrical connector mounted to the coil cover 53, as is known.

The pole piece 60, can 53, coil 50, armature 62 and flux collector 64 form an electromagnet. Lines of flux are created in an air gap between the pole piece 60 and the armature 48 when the coil 50 is energized by an electric source (such as a battery, not shown). The armature 62 moves in response to the flux. The coil 50 is energized under the control of an electronic controller (not shown) in response to various engine operating conditions, as is known. The armature 62 and valve member 48 are shown in a position in which the coil 50 is not energized, as is FIG. 1. In this position, a first portion 68 of the armature 62 is seated on the base portion 66, while a second portion 70 of the valve member 48 is not seated. In this position, there is no fluid communication between the supply passage 40 and the control passage 46. There is fluid communication between the exhaust passage 18 and the control passage 46 through chamber 58, thus also establishing fluid communication between the bypass passage 42 and the control passage 46. The rocker arms 14 and lash adjusters 16 of FIG. 1 are not actuated by the fluid provided to the control passage 46.

The pressure relief valve 28 is shown installed within the manifold 56, upstream of the drip rail 22. The pressure relief valve 28 is shown closed, but will open when spring-biased ball 72 moves away from valve seat 74 at a sufficient fluid pressure in the exhaust passage 18 that is still lower than the pressure required to actuate the rocker arm 14 and lash adjuster 16. When the pressure relief valve 28 opens, fluid is supplied to drip rail 22. Drip rail 22 is connected to the manifold 56 with a connector 75 press-fit or otherwise secured within the exhaust passage 18. Fluid in the drip rail 22 will gradually drain onto engine components 80 through apertures 82 in the drip rail 22 at a rate dependent on the fluid pressure within the drip rail 22 and the size of the apertures 82. The apertures 82 are spaced according to the positions of the engine components 80, which may be cam bearings, gears, or any engine components that benefit from consistent lubrication.

The drip rail 22 is non-linear with S-shaped curves. This shape helps to keep fluid draining through the apertures 82 from spreading along the outside of the drip rail 22, and instead positions the apertures 82 at low points on the drip rail 22 to encourage fluid to drip onto the engine components 80. Preferably the drip rail 22 is located above the engine components 80. However, depending on the operating fluid pressure within the drip rail 22, fluid could dispense sideways onto engine components 80, allowing the drip rail 22 to be positioned laterally alongside the engine components 80. The drip rail 22 is upturned at a terminal portion 84. If fluid fills the drip rail 22 and rises in the terminal portion 84, it forms a fluid head that helps to maintain pressure in the drip rail 22. The fluid will spill over the open end of the terminal portion of the drip rail 22 into the engine 10 if pressure in the drip rail 22 exceeds a certain level.

Figure 3:
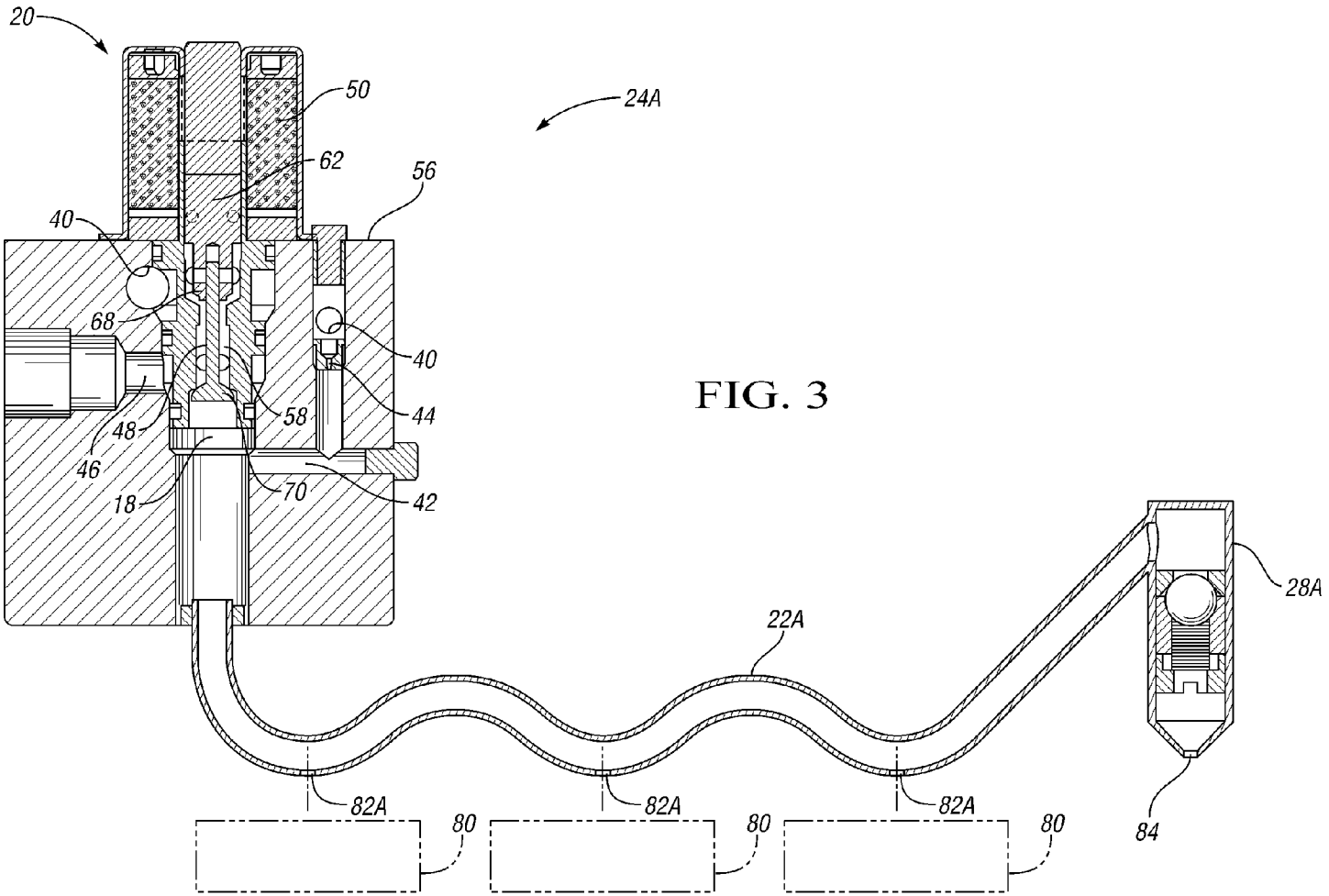
FIG. 3 is a schematic cross-sectional illustration of another embodiment of an oil control valve, pressure relief valve and drip rail for the hydraulic control system of FIG. 1.

FIG. 3 shows an alternate embodiment of an oil control valve assembly 24A that is alike in all aspects to the oil control valve assembly 24 of FIGS. 1 and 2, except that a pressure relief valve 28A is repositioned to an end of a slightly modified drip rail 22A. In FIG. 3, the coil 50 is energized, causing the armature 62 and valve member 48 to lift such that the first portion 68 of armature 62 is not seated on the base portion 66 (see FIG. 2), while the second portion 70 of valve member 48 is seated. Thus, fluid communication from the fluid supply passage 40 to the control passage 46 through chamber 58 is established. The pressure of fluid provided from the supply passage 40 is sufficient to actuate the rocker arms 14 and valve lifters 16.

While the valve member 48 is in the position shown in FIG. 3, fluid is supplied to the drip rail 22A through the exhaust passage 18 only via the bypass passage 42. Fluid drains through apertures 82A onto the engine components 80 at a rate determined by the fluid pressure within the drip rail 22A and the size of the apertures 82A. At a predetermined fluid pressure within the drip rail 22A, the pressure relief valve 28A will open, draining fluid through opening 84 into the engine 10. Because the pressure relief valve 28A is at the end of the drip rail 22A opposite the exhaust passage 18, fluid in drip rail 22A is pressurized. This helps to ensure fluid flow through the apertures 82A even at low temperatures.

Figure 4:
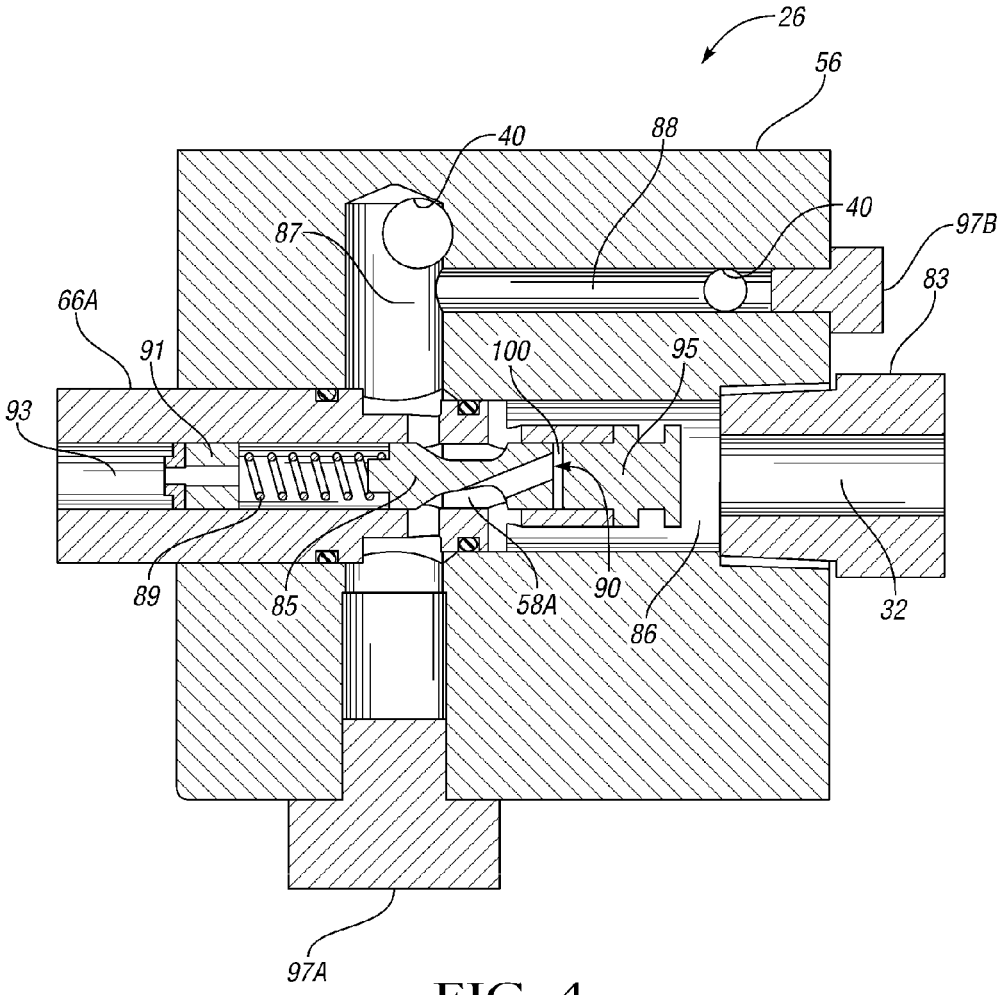
FIG. 4 is a schematic cross-sectional illustration of a pressure regulator valve for the hydraulic control system of FIG. 1.

Referring to FIG. 4, the pressure regulator valve 26 is shown in greater detail. The pressure regulator valve 26 is integrated with oil control valve 20 via a common manifold 56. The operative valve member 85 and passages of pressure regulator valve 26 are formed at a different cross-section of manifold 56 spaced from the chamber 48. The manifold 56 forms an intake chamber 86 to which fluid flows through an open plug 83 from feed passage 32. A base portion 66A of manifold 56 forms a chamber 58A. Fluid communication from the feed passage 32 through the intake chamber 86 and chamber 58A to branches passage 87 and 88 leading to the two portions of supply passage 40 is dependent upon the position of the valve member 85 via the chamber 58A. Branch passages 87 and 88 are capped by plugs 97A, 97B.

The valve member 85 is biased by spring 89 toward the open plug 83. One end of the spring 89 is held by open plug 91. When the spring 89 is in an extended position, the chamber 58A is fully open to the feed passage 32. A stationary cap 95 attached to base portion 66A limits movement of the valve member 85 toward the open plug 83. Any fluid that passes around the valve member 85 will be exhausted to the sump 30 of FIG. 1 through tank port 93. A chamber 100 is formed between the valve member 85 and the cap 95. As fluid pressure delivered from the feed passage 32 and into chamber 100 increases, a net fluid force acts on the interior surface 90 of the valve member 85, moving the valve member 85 away from the open plug 83, thus restricting communication between the chamber 58A and the intake chamber 86. Fluid transmitted through branch passages 87 and 88 to supply passage 40 (a portion of which routes through restriction 44 to supply passage 42) is thus at a lower pressure. If pressure decreases in chamber 100, the valve member 85 moves toward the open plug 83, and oil flow is increased raising the pressure delivered through chamber 58A and branch passages 87 and 88 to supply passage 40 (a portion of which routes through restriction 44 to bypass passage 42) is thus at a higher pressure. In this manner, the pressure regulator valve 26 prevents extreme drops and spikes in fluid pressure to the oil control valve 20 and the drip rail 22 or 22A. By limiting the maximum pressure, the size of the apertures 82 and 82A of drip rails 22 and 22A can be increased, improving flow at low temperatures, especially in the unpressurized drip rail 22. By preventing fluid pressure from falling below a minimum pressure, a consistent residual pressure is maintained at the rocker arms 14 and lash adjusters 16 when these components are not actuated, preventing air from entering the flow passages and reducing actuation time.

While the best modes for carrying out the invention have been described in detail, those familiar with the art to which this invention relates will recognize various alternative designs and embodiments for practicing the invention within the scope of the appended claims.

The invention claimed is:

1. An oil control valve assembly for an engine with an engine component, a cam phaser valve, and a valve lift switching component, comprising:

a control valve having a manifold defining a control passage in fluid communication with the valve lift switching component and an exhaust passage for exhausting fluid from the control valve; wherein the control valve is controllable to selectively direct fluid from a feed passage in fluid communication with the supply source to the control passage to actuate the valve lift switching component; wherein the feed passage is in fluid communication with the cam phaser valve so that pressure in the feed passage varies;

an elongated tubular member positioned adjacent the engine component and operatively connected to the exhaust passage such that fluid flows from the exhaust passage to the elongated tubular member and through the elongated tubular member onto the engine component;

a pressure relief valve in fluid communication with the exhaust passage and configured to open when pressure in the exhaust passage reaches a predetermined pressure that is less than a minimum pressure required to actuate the valve lift switching component; and a pressure regulator valve configured to regulate fluid pressure provided to the supply passage and the bypass passage via the feed passage.

2. The oil control valve assembly of claim 1, wherein the pressure relief valve is between the exhaust passage and the elongated tubular member, and wherein a portion of the elongated tubular member is configured to form a fluid head within the elongated tubular member.

3. The oil control valve assembly of claim 1, wherein the elongated tubular member is between the exhaust passage and the pressure relief valve such that fluid pressure within the elongated tubular member does not exceed the predetermined pressure.

4. The oil control valve assembly of claim 1, wherein the control valve has a bypass passage with a restriction that is in fluid communication with the exhaust passage and has a supply passage, wherein fluid flows from the supply source through the restriction and the bypass passage to the exhaust passage such that the fluid undergoes a pressure drop when it flows through the restriction, fluid flowing to the exhaust passage and the elongated tubular member from the bypass passage thereby being lower in pressure than fluid flowing from the supply passage to the control passage.

5. The oil control valve assembly of claim 1, wherein the exhaust passage is in fluid communication with the control passage when the control valve does not direct fluid from the supply passage to the control passage.

6. The oil control valve assembly of claim 1, wherein the control valve has an armature, a valve member connected to the armature, and a pole piece; wherein the manifold defines an armature chamber;

wherein the pole piece is fit in the armature chamber and the armature moves toward the pole piece when the control valve is controlled to direct fluid from the feed passage to the control passage.

7. The oil control valve assembly of claim 1, wherein the manifold defines a supply passage, a bypass passage with a restriction, and an armature chamber; wherein fluid from the supply source is supplied in parallel to both the supply passage and the bypass passage, with the fluid undergoing a pressure drop through the restriction to a pressure in the bypass passage less than a minimum pressure required to actuate the valve lift switching component.

8. The oil control valve assembly of claim 1, further comprising:

a connector fit in the exhaust passage and operatively connecting the elongated tubular member to the manifold.

9. An oil control valve assembly for an engine with a fluid source, at least one engine component, and at least one engine valve lift switching component, comprising:

an energizable solenoid valve having an armature, a valve member connected to the armature, a pole piece, and a manifold;

wherein the manifold defines a supply passage, a bypass passage with a restriction, a control passage, an exhaust passage and an armature chamber; wherein fluid from the fluid source is supplied in parallel to both the supply passage and the bypass passage, with the fluid undergoing a pressure drop through the restriction to a pressure in the bypass passage less than a minimum pressure required to actuate the at least one engine valve lift switching component; wherein the pole piece is fit in the armature chamber and the valve member is movable with the armature toward the pole piece when the solenoid valve is energized, the valve member moving from a first position in which fluid is communicated from the supply passage to the control passage to actuate the at least one engine valve lift switching component, to a second position in which fluid is not communicated from the supply passage to the control passage; wherein the bypass passage is in fluid communication with the exhaust passage regardless of the position of the valve member; and an elongated tubular member in fluid communication with the exhaust passage and having at least one aperture positioned such that fluid in the elongated tubular member flows through the at least one aperture onto the at least one engine component.

10. The oil control valve assembly of claim 9, further comprising a pressure relief valve downstream of the exhaust passage and operable to relieve pressure in the exhaust passage at a predetermined pressure.

11. The oil control valve assembly of claim 10, wherein the pressure relief valve is between the exhaust passage and the elongated tubular member, and wherein a terminal portion of the elongated tubular member is configured to form a fluid head within the elongated tubular member.

12. The oil control valve of claim 10, wherein the elongated tubular member is between the exhaust passage and the pressure relief valve such that fluid pressure within the elongated tubular member is pressurized to a pressure that does not exceed the predetermined pressure.

13. The oil control valve assembly of claim 10, wherein fluid is communicated from the bypass passage to the control passage through the exhaust passage when the valve member is in the second position; and wherein the predetermined pressure is less than a minimum pressure required to actuate the at least one engine valve lift switching component.

14. The oil control valve assembly of claim 9, further comprising:

a pressure regulator valve upstream of the solenoid valve and configured to regulate fluid pressure provided to the supply passage and the bypass passage from the fluid source.

15. The oil control valve assembly of claim 9, further comprising:

a connector fit in the exhaust passage and operatively connecting the elongated tubular member to the manifold.

16. The oil control valve assembly of claim 9, wherein the elongated tubular member has an S-shaped portion with said at least one aperture positioned at a lowest point on the S-shaped portion nearest the at least one engine component.

17. The oil control valve assembly of claim 9, wherein fluid is supplied to the supply passage through a feed passage; and wherein the engine has a cam phaser valve; and wherein the feed passage is in fluid communication with the cam phaser valve so that pressure in the feed passage varies.

18. An oil control valve assembly for an engine with an engine component and a valve lift switching component, comprising:

a control valve having a manifold defining a control passage in fluid communication with the valve lift switching component and an exhaust passage for exhausting fluid from the valve; wherein the control valve is controllable to selectively direct fluid from a supply source to the control passage to actuate the valve lift switching component;

a drip rail having a waved portion, the drip rail being positioned adjacent the engine component and operatively connected to the exhaust passage such that fluid flows from the exhaust passage to the drip rail and through the drip rail onto the engine component;

wherein the control valve has a bypass passage with a restriction that is in fluid communication with the exhaust passage and has a supply passage, wherein fluid flows from the supply source through the restriction and the bypass passage to the exhaust passage such that the fluid undergoes a pressure drop when it flows through the restriction, fluid flowing to the exhaust passage and the drip rail from the bypass passage thereby being lower in pressure than fluid flowing from the supply passage to the control passage; and a pressure relief valve in fluid communication with the exhaust passage and configured to open when pressure in the exhaust passage reaches a predetermined pressure that is less than a minimum pressure required to actuate the valve lift switching component.

19. The oil control valve assembly of claim 18, further comprising:

wherein the engine has a cam phaser valve; wherein a feed passage connects the supply source with the pressure regulated valve; wherein the feed passage is in fluid communication with the cam phaser valve so that pressure in the feed passage varies; and a pressure regulator valve configured to regulate fluid pressure provided to the supply passage and the bypass passage from the supply source.

20. The oil control valve assembly of claim 19, wherein the pressure relief valve is operatively connected to the drip rail at an end of the drip rail opposite the exhaust passage so that the drip rail is between the exhaust passage and the pressure relief valve fluid pressure within the drip rail is pressurized to a level that does not exceed the predetermined pressure.

* * * * *